US008192243B2

(12) United States Patent
Jorgensen

(10) Patent No.: US 8,192,243 B2
(45) Date of Patent: Jun. 5, 2012

(54) CONTAINER FOR STORING AN INFLATABLE LIFERAFT

(75) Inventor: Kent Molsted Jorgensen, Esbjerg (DK)

(73) Assignee: Viking Life-Saving Equipment A/S, Esbjerg (DK)

( * ) Notice: Subject to any disclaimer, the term of this patent is extended or adjusted under 35 U.S.C. 154(b) by 116 days.

(21) Appl. No.: 11/572,969

(22) PCT Filed: Jun. 27, 2005

(86) PCT No.: PCT/DK2005/000432

§ 371 (c)(1),
(2), (4) Date: Jan. 31, 2007

(87) PCT Pub. No.: WO2006/015595

PCT Pub. Date: Feb. 16, 2006

(65) Prior Publication Data

US 2007/0243779 A1 Oct. 18, 2007

(30) Foreign Application Priority Data

Aug. 9, 2004 (DK) ..... 2004 01209

(51) Int. Cl.
*B63C 9/22* (2006.01)

(52) U.S. Cl. ..... 441/35

(58) Field of Classification Search ..... 441/40–42, 441/35; 73/73–77, 49.3, 52; 53/428, 432, 53/434, 111 R, 510

See application file for complete search history.

(56) References Cited

U.S. PATENT DOCUMENTS

| | | | | |
|---|---|---|---|---|
| 4,515,751 | A * | 5/1985 | Krieg, Jr. | 422/86 |
| 4,597,285 | A | 7/1986 | Kuchar et al. | |
| 4,666,413 | A | 5/1987 | Klein et al. | |
| 5,342,230 | A | 8/1994 | Louis | |
| 5,630,740 | A | 5/1997 | Lavorata | |
| 6,658,915 | B2 * | 12/2003 | Sunshine et al. | 73/23.2 |
| 7,030,631 | B1 | 4/2006 | Jennings | |
| 7,196,622 | B2 | 3/2007 | Lambright et al. | |
| 2004/0017300 | A1 * | 1/2004 | Kotzin et al. | 340/870.11 |
| 2007/0167093 | A1 * | 7/2007 | Scott et al. | 441/42 |

FOREIGN PATENT DOCUMENTS

CN 1210959 A 3/1999

(Continued)

OTHER PUBLICATIONS

International Preliminary Report on Patentability (IPRP) corresponding to International Application No. PCT/DK2005/000432, European Patent Office, dated Jan. 5, 2007, 5 pages.

(Continued)

*Primary Examiner* — Edwin Swinehart

(74) *Attorney, Agent, or Firm* — Wood, Herron & Evans, L.L.P.

(57) ABSTRACT

The present invention relates to a container for storing an inflatable liferaft, the container including a bag adapted to contain a deflated liferaft and means for inflating the liferaft using an inflating gas, preferably $CO_2$ or a mixture of gasses, wherein the substantial part is $CO_2$. The inflating means being connected to the liferaft, preferably being substantially contained inside the bag. The bag furthermore has means for measuring and/or monitoring at least the relative humidity (R.H.) and the $CO_2$-content of the gas inside the bag.

13 Claims, 1 Drawing Sheet

FOREIGN PATENT DOCUMENTS

| | | | |
|---|---|---|---|
| DE | 7401130 | U | 5/1974 |
| DE | 8332705 | U | 6/1986 |
| EP | 0193018 | | 9/1986 |
| EP | 1 781 537 | B1 | 1/2008 |
| GB | 2296482 | A | 7/1996 |
| GB | 2318097 | A | 4/1998 |
| GB | 2382201 | A | 5/2003 |
| WO | 97/05014 | | 2/1997 |
| WO | 02/066321 | A1 | 8/2002 |
| WO | 2004/110858 | A1 | 12/2004 |
| WO | WO 2006/015595 | A1 | 2/2006 |

OTHER PUBLICATIONS

International Search Report corresponding to International Application No. PCT/DK2005/000432, European Patent Office, dated Dec. 23, 2005, 5 pages.

* cited by examiner

CONTAINER FOR STORING AN INFLATABLE LIFERAFT

FIELD OF THE INVENTION

The present invention relates to a container for storing an inflatable liferaft, said container comprising a bag adapted to contain a deflated liferaft and means for inflating the liferaft by means of an inflating gas, preferably $CO_2$ or a mixture of gases, wherein the substantial part is $CO_2$. Said means being connected to the liferaft, preferably being substantially contained inside the bag. The bag further containing a gas such as air.

The invention furthermore relates to a method for monitoring the environment parameters in a bag. The invention also relates to a bag for a deflated liferaft and a monitoring device.

BACKGROUND ART

Inflatable liferafts enclosed in the self-opening containers are well known and are used as mandatory life-saving equipment throughout the world on almost any commercial ship and vessel of a given size.

In this context the liferaft in its container can be considered to be permanently secured to the ship and are normally only dismounted when the liferaft is to be serviced at a land-based service-station, e.g. once yearly, or when other types of maintenance takes place on the ship.

Indeed, when the liferaft is deployed in an emergency case the container is liberated corresponding to its mounting means and, typically, dropped into the water where the container will open and the liferaft inflate. The typical size for such a permanently mounted liferaft may be for 4 to 150 persons.

As mentioned above the liferafts are according to SOLAS Rules (Convention for the Safety of Life at Sea) to be inspected and serviced periodically. The reason for this is to obtain the highest degree of safety and for enabling a reliable checking as well as maintenance of the liferafts.

In the known service-checks the liferafts are dismounted from the ship or vessel, for instance when being in a harbour, and transported to an authorised service-station. At the service-station the liferafts are unpacked, inflated and then inspected. The inspection reveals any damage on the liferafts either on the material of the liferaft or for instance corrosion on metal parts. Furthermore, the means for inflating the liferaft is being inspected.

In addition to the physical inspection of the liferaft, the service-check may also contain replacement of elements, which are enclosed in the liferafts, and which have limited durability such as for instance batteries, medicine, distress signals or emergency rations.

After the inspection (and possible repair) and the replacement of the above mentioned elements the liferaft is repacked and replaced in the container and finally returned to the ship or vessel.

The above mentioned service-checks are time consuming. Furthermore, due to the fact that the service-check takes long time to execute, the ship or vessel, whereupon the liferafts are situated, has to stay in the harbour, which may be expensive for the shipowner. There is thus a need for providing a liferaft having less time consuming service-checks.

The liferafts are stored on the deck of a ship or vessel, which may expose the liferafts for different environmental changes such as wind, sun, salt, water and/or moisture. The outer container, which houses the liferaft, is capable of protecting the liferaft against the mechanical actions, however, it is not suitable for protecting the liferaft against for instance moisture. The reasons for this is that in the prior art it has not yet been possible to provide a secure sealing of the container.

When the liferaft is exposed to moisture it may have the result that the material of the liferaft is starting to be weakened, which may reduce the life of the liferaft.

Furthermore, moisture, especially salt containing moisture, has corrosion effect on the different metal parts or attachments on the liferafts.

For protecting the inflatable liferaft it is known to place the liferaft in a bag, and provide the bag with a vacuum, as for instance described in GB 2 296 482.

However, it is known in the prior art that constant mechanically actions, such as for instance sharp bends of the material of the liferaft, may result in a weakening of the material. As the bag is exposed to the vacuum the liferaft is pressed further together in the bag which additionally provides more sharp bends of the material and thereby additional weakening of the material.

Furthermore, the vacuum bag has the disadvantage that if the bag breaks, air and thereby moisture will be sucked into the bag, which also may provide weakening to the material of the liferaft.

There is thus a need for providing a liferaft, which is not exposed for a constant pressure, i.e. vacuum as well as for providing a liferaft, which is protected against the outer environment, and a liferaft which condition may be measured without unpacking said liferaft.

SUMMARY OF THE INVENTION

An object of the present invention is to wholly or partially overcome the above disadvantages of the prior art. More specifically, it is an object to provide a liferaft wherein service-checks may be performed onboard the ship or vessel.

It is furthermore an object of the invention to provide a liferaft wherein the status of the liferaft may be evaluated without unpacking and inflating the liferaft.

It is also an object of the invention to provide a liferaft which is not exposed to a constant vacuum.

Additionally, it is an object of the present invention to provide a method for evaluating the status of a liferaft without unpacking and inflating the liferaft.

The above objects, together with numerous other objects, advantages and features, which will become evident from the below description, are accomplished by a solution in accordance with the present invention by the bag comprises means for measuring and/or monitoring at least the relative humidity (R.H.) and the $CO_2$-content of the gas inside the bag.

Hereby is obtained that on basis of the monitored environmental parameters inside the bag it is possible to evaluate the status of the liferaft without unpacking and inflating it. By evaluating the monitored environmental parameters, for instance the moisture content of the air/gas, i.e. the relative humidity (R.H.), it is possible to estimate how much moisture the material of the liferaft have been exposed to since the last service-check and thereby whether the liferaft needs to have a full service-check, i.e. unpacking, inflating and physical inspection.

The term "means for measuring and/or monitoring" is in this context to be construed as being either external means, i.e. means which are placed outside the bag or in connection with the bag, or internal means, i.e. means which is placed inside the bag.

It is furthermore possible to control the status of the means for inflating the liferaft, i.e. whether the $CO_2$-container is leaking $CO_2$ and thereby has lost it's inflating capacity, which may have severe consequences in an emergency situation. It should be mentioned that if the inflating gas is a mixture of gases and if, for instance, a tracer is added to the inflating gas, it is within the inventive idea that the means for measuring and/or monitoring the $CO_2$-content of the gas inside the bag as well is capable of measuring and/or monitoring other gases or a tracer of the gas inside the bag.

Additionally it is obtained that deflated liferaft is located in a bag, so that the liferaft is exposed as little as possible for the surrounding environment and that the condition of the liferaft may be controlled without the liferaft being unpacked from the bag.

According to the invention a pressure in the bag may substantially be equal to ambient pressure, i.e. atmospheric pressure, whereby it is obtained that the liferaft when contained in the bag not will be exposed for further pressing provided by a vacuum.

Advantageously according to the invention the bag may comprise at least one arrangement for providing a dehumidified environment in the bag. By providing at least one arrangement inside the bag it is obtained that any moisture present inside the bag may be absorbed by the arrangement so that a dehumidified environment always is provided in the bag which have ideal conditions for the material of the liferaft.

Furthermore, the bag may comprise a terminal for taking out at least part of the gas inside the bag. Hereby, the gas, i.e. air, may be evaluated in a simple and expedient manner. In a preferred embodiment substantially all the gas inside the bag may be sucked out, partly for increase the size of the sample which is to be measured and evaluated and partly for creating a temporary vacuum in the bag which may be used for controlling the imperviousness of the bag in relation to a predetermined level. In the latter the case is that when a predetermined vacuum is obtained the sucking out of gas is stopped, wherein after a pressure gradient (i.e. a pressure change as the function of time) is measured.

According to a preferred embodiment according to the invention the terminal of the bag may extend from the bag to the outside of the container so that the gas inside the bag may be monitored as well as evaluated without the container needs to be opened. In expedient manner the terminal of the bag may comprise a valve, whereby it is possible to suck out the air/gas in the bag and afterwards blow air/gas inside the bag again for obtaining the ambient pressure.

Advantageously the bag may be made of a material which substantially is impermeable for gases and/or moisture.

Furthermore, in a preferred embodiment according to the invention the material of the bag may per se be breakable and/or may comprise means for breaking the material.

The material of the bag may advantageously comprise at least one layer, which enables welding or gluing for sealing the bag. Hereby is obtained that the packaging of the liferaft inside the bag may be carried out in a simple and expedient manner.

According to the invention the bag may comprise an opening arrangement adapted to provide access to the interior of the bag so that batteries, medicine, distress signals, emergency rations or dehumidifying arrangements may be replaced without breaking the material of the bag.

In a preferred embodiment according to the invention a monitoring device for measuring the relative humidity (R.H.) and the $CO_2$-content inside the bag may be arranged in or in connection with the container.

The monitoring device may advantageously be able to communicate wireless, e.g. via GSM. Hereby is obtained, that the status of the liferaft may be monitored from a remote location such as for instance by the service-station or by the provider of the liferaft.

Furthermore, the means for measuring and/or monitoring at least the relative humidity (R.H.) and the $CO_2$-content of the gas inside the bag may be directly connected to, e.g. by a wire, or communicating wireless with the monitoring device. Hereby it is obtained that the relative humidity and the $CO_2$-content of the gas inside the bag may be measured as well as monitored, for instance by placing a probe permanently in the bag or on the liferaft, without taking out a sample of the air of the bag. In this embodiment according to the invention the measurement and/or monitoring may be carried out continuously or by intermittently measurements.

In an expedient embodiment according to the invention the container may comprise a liner for protecting the bag which liner is releasable from the container during inflating of the liferaft.

The present invention furthermore relates to a method for measuring and/or monitoring the environment parameters inside a bag which is adapted to contain a deflated liferaft, said bag comprises means for inflating the liferaft by means of an inflating gas, preferably $CO_2$ or a mixture of gases, wherein the substantial part is $CO_2$, said means being connected to the liferaft, preferably being substantially contained inside the bag, the bag further containing a gas such as air. Said method comprising the steps of connecting a monitoring device to a terminal arranged in connection with the bag, taking out at least part of the gas inside the bag, and measuring that part of the gas at least for its relative humidity (R.H.) and the $CO_2$-content.

BRIEF DESCRIPTION OF THE DRAWINGS

The invention and its advantages will be described in more detail below with reference to the accompanying schematic drawings, which by way of example illustrate currently preferred embodiments of the invention.

All the figures are highly schematic and not necessarily to scale, and they show only parts which are necessary in order to elucidate the invention, other parts being omitted or merely suggested.

DESCRIPTION OF PREFERRED EMBODIMENTS

Figure 1:
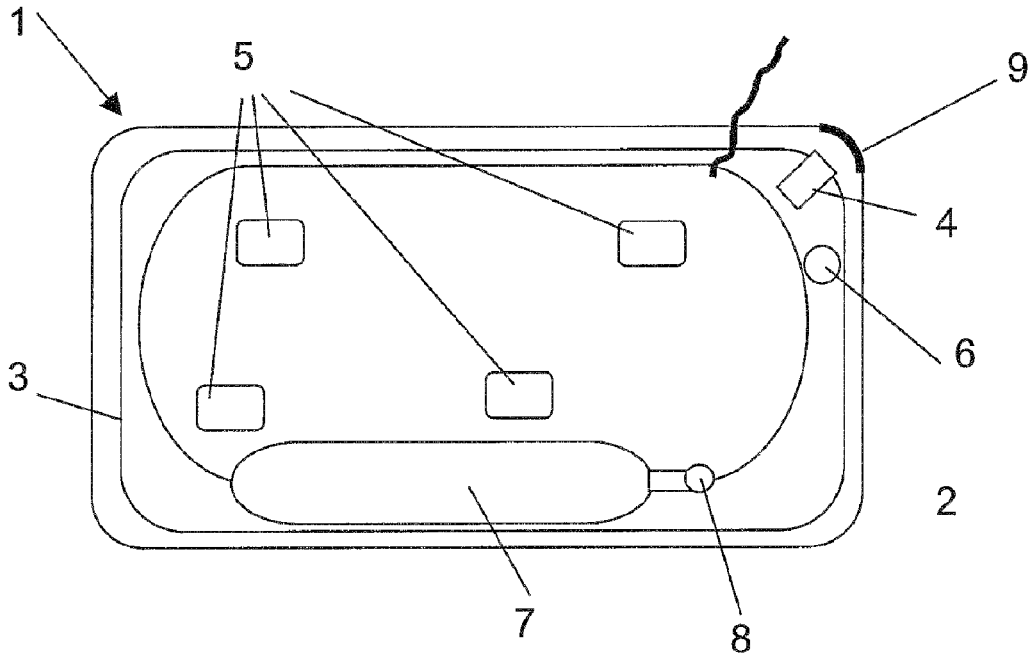
FIG. 1 shows a sectional view of a container for storing an inflatable liferaft packed in a bag according to the invention.

FIG. 1 shows schematically a sectional view of a container 1 for storing an inflatable liferaft 2, comprising a bag 3 adapted to contain a deflated liferaft 2, and means 7 for inflating the liferaft 2 which is connected to the liferaft 2 via a valve 8 and the means is here shown as contained completely inside the bag 3. The inflating means may expedient be a $CO_2$-container. Furthermore, the bag 3 comprises means 4 for measuring and/or monitoring the relative humidity (R.H.) and the $CO_2$-content of the gas inside the bag 3. Said means 4 may comprise a terminal for connection to for instance a monitoring device. According to the invention other environmental parameters inside the bag may also be measured and/or monitored which will be appreciated by the skilled person.

When the liferaft is packed into the container 1 the air or gas inside the bag 3, containing the liferaft, is sucked out of the bag via the terminal for thereby providing a temporary vacuum which minimises the volume of the deflated liferaft 2 before the liferaft is placed in the container. Subsequently, the bag 3 is provided with some gas, such as air or dry air, so that the pressure in the bag 3 is substantially equal to ambient pressure, i.e. atmospheric pressure. Thus, the liferaft is then during storing in the container not under pressure and the problems of weakening of the material of the liferaft due to sharp bends are hereby limited.

The bag 3 according to an embodiment of the invention may comprise at least one arrangement 5 for providing a dehumidified environment in the bag 3. The need for such dehumidifying of the bag is due to the material of the liferaft when exposed to moisture or water may be influenced and thereby weakened. The moisture or water comes from condensation, seawater, cleaning water or even the moisture present in the air.

The arrangement 5 of the present invention may for instance be in form of sachets, which may be made of filter paper which are permeable and which are filled with water or moisture absorbent powder or the like.

In FIG. 1 four sachets is shown which provide an excessive capacity for dehumidifying the environment in the bag 3. Provided that the bag is filled with dry air no sachets should be needed, however, the bag may be provided with sachets anyway so as to avoid that any moisture entering the bag influences the material of the liferaft.

The sachets may be fasten to the package ribbons (not shown) which are adapted to keeping the liferaft compact after being folded. The sachets may in other embodiments be fasten to the inside of the bag or directly to the outside of the liferaft. Instead of sachets the moisture contained in the bag may be absorbed by the material of the bag or for instance a liner inside the bag, which material or liner may be of an absorbing material or be provided with capillary tubes. The sachets may be replaced by other means which removes the moisture from the liferaft, such as a special gas which is unsaturated when entering the bag.

Additionally, the bag according to the invention may comprise an opening arrangement 6 adapted to provide access to the interior of the bag 3. By this access, it is possible to replace the dated items in an emergency pack and/or to take out test samples of the material used to make the liferaft, such as e.g. glue, rubber, plastic and/or fabric. The dated items may be medicine, food and the like which has a limited durability.

Furthermore, the container of FIG. 1 is shown with an opening for providing access to the bag. This opening may be in form of a lid 9 provided with sealing means in the circumference of the lid 9 for providing a substantially water sealed container when the lid 9 is closed. The lid 9 may also be provided with a window glass for visual control of the bag.

Figure 2:
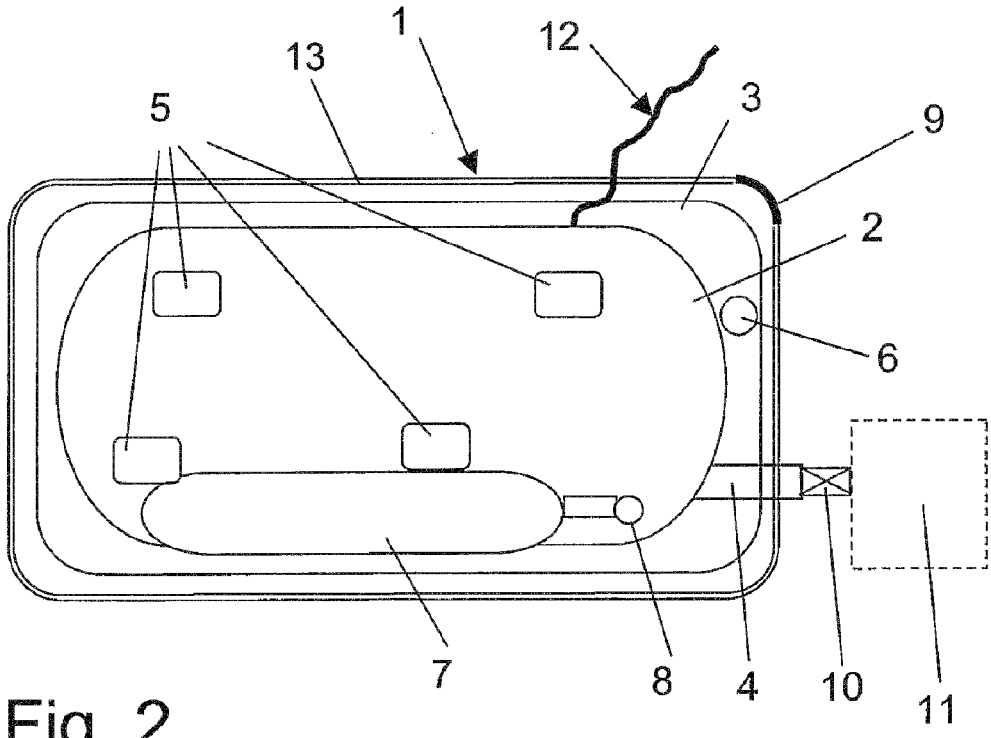
FIG. 2 shows a sectional view of a container according to another embodiment of the present invention.

In FIG. 2 another embodiment of the container according to the invention is shown which may be supplied with a terminal of the bag 3 which extends from the bag 3 to the outside of the container 1. This access to the gas of the interior of the bag from the outside of the container enables monitoring of the environmental parameters of the gas without opening the container. It is hereby possible to take out part of the gas inside the bag for measuring the environment which surrounds the liferaft. The measuring of the environmental parameters of the gas in the bag enables an evaluation of the condition and/or status of the liferaft. The liferaft inspection may hereby be limited to measuring these environmental parameters for evaluating and thereby predicting the condition of the liferaft and the time between the complete service-checks may be increased.

Additionally, the container 1 may comprise a terminal of the bag 3 with for instance a valve 10. In this embodiment the monitoring of the environment of the gas inside the bag is carried out by emptying, i.e. sucking out, the bag for gas and thereby creating a temporary vacuum in the bag which may be used for controlling the imperviousness of the bag in relation to a predetermined level. In this case when the predetermined vacuum is obtained the sucking out of gas is stopped, wherein after a pressure gradient (i.e. a pressure change as the function of time) is measured.

Furthermore the emptied gas is measured, when leaving the bag, at least the relative humidity (R.H.) and the $CO_2$-content is compared to reference data for the gas which the bag was filled with. By this comparison of the measured data and the reference data the condition of the environment by which the liferaft has been stored is determined and thereby it is possible to observe whether the liferaft has been exposed to an uncontrolled environment (i.e. moisture) and whether the means for inflating the liferaft has leaked for instance if there is a high content of $CO_2$ in the gas. Subsequently, provided that the environment is under control, the bag is refilled with gas, such as air from the surroundings of the container or for instance dry air.

The reference data may be entered into the monitoring device by manual keying in the data from a record of the data for inlet gas during packing or data for the gas from prior refilling after measuring of the environment of the liferaft. The reference data may as well be entered into the device by reading of a barcode or radio frequency (RFID) or may be entered ahead as a predetermined acceptance level.

The container may comprise a monitoring device 11 for measuring the environmental parameters. This device is in FIG. 2 shown as being outside the container, but may as well be situated inside the container or be a part of the container.

In an additional embodiment the monitoring device is supplied with communication means to be adapted to communicate wireless, e.g. via GSM. By this wireless communication it is possible for the inspection authorities, service-stations or liferaft providers to monitor the liferaft from a remote location and merely make on-board inspections on liferaft which environmental parameters (relative humidity and $CO_2$-content) seems to be no longer under control.

Advantageously, the container according to an additional embodiment of the invention comprises a liner 13 for protecting the bag 3 which liner 13 is releasable from the container during inflating of the liferaft 2. By providing the container with a releasable liner, the container is still satisfying the requirements from the authorities that the container is sinkable when entering the water in an emergency operation. The liner is released from the container during the inflation of the liferaft.

The bag shown in FIGS. 1 and 2 is made of a material which substantially is impermeable for gases and/or moisture, such as aluminium foil, rubber, polyurethane, silicone or the like material.

The material of the bag 3 may per se be breakable such as aluminium foil and/or comprise means for breaking the material. This breakability of the material of the bag 3 is needed for not hindering the inflation of the liferaft. By means for breaking the material is meant a net e.g. embedded in the material of the bag. The net may be made of a material, such as glass fibres or the like, which is able to transfer the forces of releasing means to cut through the material of the bag.

Furthermore the bag may comprise a so-called tear string (not shown) which is arranged to provide a fast access to a lifting arrangement on the liferaft when the liferaft is to be lowered from the deck of the ship.

The material of the bag 3 according to the present invention comprises at least one layer which enables welding or gluing for sealing the bag 3. Such layer may be made of polyethylene, polyethylene-vinyl-acetate or the like which enables welding, or the layer may hot melt adhesive.

In an further embodiment of the present invention the bag may comprise an additional layer which may provide a wear layer and/or a layer having temperature constant property to the bag. Such layer may be made in polyethylene, polyethylene-terephtalat or the like material.

Furthermore, the liferaft may comprise a mooring line, which is connected to the liferaft without breaking the sealing of the bag. The liferaft may also comprise a painter line and other lines.

The invention further relates to a bag 3 for containing an inflatable liferaft 2, comprising means 4 for monitoring environmental parameters inside the bag 3, such as temperature, pressure, moisture content and the like. This bag 3 is in an embodiment of the present invention made of a material which substantially is impermeable to gases and/or moisture. Additionally, the material of the bag per se is breakable and/or comprises means for breaking the material according to an further embodiment of the invention.

Furthermore, the invention also relates to a monitoring device 11 for measuring and/or monitoring at least the relative humidity (R.H.) and the $CO_2$-content of the gas inside the bag 3. Advantageously, the monitoring device may be portable.

Additionally, the invention relates to a method for measuring and/or monitoring the environment parameters inside a bag 3 which is adapted to contain a deflated liferaft 2, said bag comprises means for inflating the liferaft by means of an inflating gas, preferably $CO_2$ or a mixture of gases, wherein the substantial part is $CO_2$, said means being connected to the liferaft 2, preferably being substantially contained inside the bag 3, the bag further containing a gas such as air, the method comprising the step of connecting a monitoring device 11 to a terminal arranged in connection with the bag 3, taking out at least part of the gas inside the bag, and measuring that part of the gas at least for its relative humidity (R.H.) and the $CO_2$-content.

By using the inventive idea it is obtained that on basis of the measured and/or monitored relative humidity and the $CO_2$-content of the gas inside the bag it is possible to evaluate the status of the liferaft without unpacking and inflating it.

Furthermore it is possible to estimate how much moisture the material of the liferaft have been exposed to since the last service-check and thereby whether the liferaft needs to have a full service-check, i.e. unpacking, inflating and physical inspection.

It is also possible to control the condition or status of the means for inflating the liferaft, i.e. whether the $CO_2$-container is leaking $CO_2$ and thereby has lost it's inflating capacity, which may have severe consequences in an emergency situation.

Although the invention above has been described in connection with preferred embodiments of the invention, it will be evident for a person skilled in the art that several modifications are conceivable without departing from the invention as defined by the following claims.

The invention claimed is:

1. A container for storing an inflatable liferaft in a gaseous environment, comprising:

a bag adapted to contain a deflated liferaft, the bag further containing gas, a cylinder of compressed gas for inflating the liferaft, said compressed gas comprising a substantial part of $CO_2$, said compressed gas cylinder being connected to the liferaft and substantially contained inside the bag, a terminal positioned at least partially within the bag so as to be operable to measure data representative of the environment within the bag without opening the bag, and a device for monitoring the environmental parameters within said bag by:

recording reference data;

receiving the measured data from the;

comparing the measured data to the reference data; and communicating the condition of the environment in which the life raft has been stored based on a comparison of measured data and reference data.

2. The container of claim 1, wherein a pressure in the bag is substantially equal to ambient pressure.

3. The container of claim 1, wherein the bag comprises at least one arrangement for providing a dehumidified environment in the bag.

4. The container of claim 1, wherein the terminal extends from the bag to the outside of the container such that the monitoring device can be connected directly to the terminal in order to receive the data without opening the container.

5. The container of claim 1, wherein the terminal comprises a valve.

6. The container of claim 1, wherein the bag is made of a material which is substantially impermeable for gases and/or moisture.

7. The container of claim 1, wherein the material of the bag is breakable and/or comprises means for breaking the material.

8. The container of claim 1, wherein the bag comprises an opening arrangement adapted to provide access to the interior of the bag.

9. The container of claim 1, wherein the monitoring device is arranged in or in connection with the container.

10. The container as claimed in claim 9, wherein the monitoring device receives the data by means of wireless communication with the terminal.

11. The container of claim 1, wherein the terminal is fully within the bag, and wherein the terminal measuring data and the monitoring device receiving the measured data both occur without opening the bag.

12. The container of claim 11, wherein the monitoring device is fully within the bag, the terminal and monitoring device forming an integral device operable to measure and monitor conditions within the bag.

13. A container for storing an inflatable liferaft in a gaseous environment, comprising:

a bag adapted to contain a deflated liferaft, the bag further containing air, a cylinder of compressed gas for inflating the liferaft, said compressed gas comprising a substantial part of $CO_2$, said compressed gas cylinder being connected to the liferaft and substantially contained inside the bag, a terminal extending from within the bag to outside the container, the terminal operable to remove a sample of air from the bag without opening the container, and a device for monitoring the environmental parameters within said bag by:

recording reference data;

measuring the removed sample of air to acquire data representative of the environment within the container;

comparing the measured data to the reference data; and communicating the condition of the environment in which the life raft has been stored based on a comparison of measured data and reference data.

* * * * *

UNITED STATES PATENT AND TRADEMARK OFFICE

CERTIFICATE OF CORRECTION

PATENT NO. : 8,192,243 B2
APPLICATION NO. : 11/572969
DATED : June 5, 2012
INVENTOR(S) : Kent Molsted Jorgensen It is certified that error appears in the above-identified patent and that said Letters Patent is hereby corrected as shown below:

Title page, item [57] line 4, Abstract, "... or a mixture of gasses, ..." should read --... or a mixture of gases, ...--

Column 1, lines approx. 24-25, "... the liferaft in ... and are normally only ..." should read --... the liferaft in ... and is normally only ...--

Column 1, line approx. 64, "... may expose the liferafts for different ..." should read --... may expose the liferafts to different ...--

Column 2, line 2, "The reasons for this is that ..." should read --The reason for this is that ...--

Column 2, lines approx. 13-14, "... constant mechanically actions, such as ..." should read --... constant mechanical actions, such as ...--

Column 2, lines approx. 24-28, "There is thus a need for providing a liferaft, which is not exposed for a constant pressure, i.e. vacuum as well as for providing a liferaft, which is protected against the outer environment, and a liferaft which condition may be measured without unpacking said liferaft." should read --There is thus a need for providing a liferaft which is not exposed to a constant pressure, i.e. vacuum, as well as for providing a liferaft which is protected against the outer environment, and a liferaft in which conditions may be measured without unpacking the liferaft.--

Column 2, line approx. 47, "... by the bag comprises means ..." should read --... by the bag comprising means ...--

Column 3, line approx. 9, "... exposed as little as possible for the ..." should read --... exposed as little as possible to the ...--

Column 3, line approx. 17, "... not will be exposed for further pressing ..." should read --... will not be exposed to further pressing ...--

Signed and Sealed this
Twenty-third Day of October, 2012

David J. Kappos

David J. Kappos
*Director of the United States Patent and Trademark Office*

Column 3, lines approx. 24-25, "... environment ... provided in the bag which have ideal ..." should read --... environment ... provided in the bag which has ideal ...--

Column 3, lines approx. 30-32, "... partly for increase the size of ... and partly for creating a ..." should read --... partly for increasing the size of ... and partly for creating a ...--

Column 3, lines approx. 42-43, "... evaluated without the container needs to be opened." should read --... evaluated without the container needing to be opened.--

Column 3, line approx. 48, "... substantially is impermeable for gases ..." should read --... substantially is impermeable to gases ...--

Column 3, last two lines, "... be able to communicate wireless, ..." should read --... be able to communicate wirelessly, ...--

Column 4, line approx. 7, "... or communicating wireless with the ..." should read --... or communicating wirelessly with the ...--

Column 5, line approx. 20, "In FIG. 1 four sachets is shown which ..." should read --In FIG. 1 four sachets are shown which ...--

Column 5, lines approx. 25-27, "... sachets may be fasten to ... which are adapted to keeping the liferaft compact ..." should read --... sachets may be fastened to ... which are adapted to keep the liferaft compact ...--

Column 6, lines approx. 33-34, "... adapted to communicate wireless, ..." should read --... adapted to communicate wirelessly, ...--

Column 6, lines approx. 37-38, "... merely make on-board inspections on liferaft which environmental parameters ... seems to be no longer under control." should read --... merely make on-board inspections on liferafts where environmental parameters ... seem to be no longer under control.--

Column 7, line 2, "... or the layer may hot melt adhesive." should read --... or the layer may be hot melt adhesive.--

Column 7, line 6, "... may be made in polyethylene, ..." should read --... may be made of polyethylene, ...--

Column 7, lines approx. 41-42, "... moisture the material of the liferaft have been exposed to ..." should read --... moisture the material of the liferaft has been exposed to ...--

Column 8, line 8, Claim 1, "...receiving the measured data from the; ..." should read --... receiving the measured data from the terminal; ...--

Column 8, line 11, Claim 1, "... which the life raft has been ..." should read --... which the liferaft has been ...--

Column 8, line 65, Claim 13, "... which the life raft has ..." should read --... which the liferaft has ...--